US009427748B2

(12) United States Patent
Marro

(10) Patent No.: US 9,427,748 B2
(45) Date of Patent: Aug. 30, 2016

(54) CENTRIFUGE SYSTEM AND METHOD THAT DETERMINES FILL STATUS THROUGH VIBRATION SENSING

(75) Inventor: T. David Marro, Magnolia, MA (US)

(73) Assignee: PNEUMATIC SCALE CORPORATION, Cuyahoga Falls, OH (US)

( * ) Notice: Subject to any disclaimer, the term of this patent is extended or adjusted under 35 U.S.C. 154(b) by 1010 days.

(21) Appl. No.: 13/635,511

(22) PCT Filed: Mar. 28, 2011

(86) PCT No.: PCT/US2011/030130

§ 371 (c)(1),
(2), (4) Date: Sep. 17, 2012

(87) PCT Pub. No.: WO2011/123371

PCT Pub. Date: Oct. 6, 2011

(65) Prior Publication Data

US 2013/0012371 A1 Jan. 10, 2013

Related U.S. Application Data

(60) Provisional application No. 61/320,479, filed on Apr. 2, 2010.

(51) Int. Cl.

| | |
|---|---|
| ***B04B 9/10*** | (2006.01) |
| ***B04B 13/00*** | (2006.01) |
| ***B04B 11/02*** | (2006.01) |

(52) U.S. Cl.

CPC ..... *B04B 13/00* (2013.01); *B04B 9/10* (2013.01); *B04B 11/02* (2013.01)

(58) Field of Classification Search

CPC ..... B04B 9/10; B04B 9/14; B04B 9/146; B04B 13/00; B04B 11/02; B04B 11/04; B04B 2009/143

USPC ..... 494/6, 7, 37

See application file for complete search history.

(56) References Cited

U.S. PATENT DOCUMENTS

| | | | | |
|---|---|---|---|---|
| 5,736,054 | A * | 4/1998 | Feller | G01F 23/22 210/739 |
| 5,948,271 | A | 9/1999 | Wardwell et al. | |
| 6,296,774 | B1 * | 10/2001 | Henkel | B04B 11/043 210/744 |
| 6,328,897 | B1 * | 12/2001 | Leung | B04B 11/043 210/143 |
| 6,350,224 | B1 | 2/2002 | Cordaro et al. | |
| 2003/0101519 | A1 | 6/2003 | Gayme et al. | |
| 2007/0267360 | A1 * | 11/2007 | Pham | C07K 1/30 210/787 |
| 2008/0234121 | A1 | 9/2008 | Kim et al. | |
| 2010/0009833 | A1 | 1/2010 | Ryu et al. | |

FOREIGN PATENT DOCUMENTS

| | | | | |
|---|---|---|---|---|
| EP | 0724912 | A1 * | 8/1996 | B04B 11/043 |
| JP | 2008-306584 | | 6/2010 | |
| WO | WO 2006007459 | A1 * | 1/2006 | C07K 1/30 |

* cited by examiner

*Primary Examiner* — Charles Cooley
*Assistant Examiner* — Shuyi S Liu
(74) *Attorney, Agent, or Firm* — Ralph E. Jocke; Walker & Jocke

(57) ABSTRACT

A centrifuge may include a bowl operative to rotate with respect to a stationary portion. The centrifuge may include at least one vibration sensor operative to generate vibration data representative of vibrational movement of portions of the centrifuge. The processor may monitor the vibration data as the bowl is being filled with a fluid. The processor may cause a drive device to increase the rotational speed of the bowl responsive to determining from the vibration data that the bowl has becoming substantially filled with a fluid.

12 Claims, 5 Drawing Sheets

CENTRIFUGE SYSTEM AND METHOD THAT DETERMINES FILL STATUS THROUGH VIBRATION SENSING

BACKGROUND

Semi-continuous process centrifuges may operate by feeding a fluid comprising a liquid-solid suspension into a rotating bowl, sedimenting solids, and discharging liquid until the bowl is filled or is substantially filled to capacity with solids. Once the bowl is filled to capacity with solids, bowl rotation is stopped and the solids are discharged from the bowl. Thereafter, the next cycle in the process is initiated by again feeding the fluid into the rotating bowl, sedimenting solids, discharging liquid, followed by discharging the solids when the bowl is once again sufficiently filled.

Some types of semi-continuous centrifuges operate at relatively lower rotational speeds while the bowl is being filled with fluid from an empty state to avoid excessive vibrations (caused by the fluid sloshing around in the unfilled space of the bowl). In some centrifuges (e.g., a ViaFuge manufactured by Pneumatic Scale Angelus), a user visually monitors the centrifuge to determine when the bowl is filled with fluid, at which point the user stops the feed pump and manually increases the rotational speed of the filled bowl to correspond to the appropriate processing speed for the liquid-solid suspension that is to be separated. Upon reaching the appropriate increased rotational processing speed, the pumping of the fluid into the bowl is resumed. When the desired amount of fluid has been processed, and/or the bowl is filled with a maximum level of solids, the bowl rotation is stopped and the solids collected in the bowl are discharged.

In this system, a user visually determines when the bowl is filled with the fluid by observing when liquid begins to overflow from a discharge port. The composition of the overflowing liquid may be either feed suspension or liquid separated from the suspension, which is called centrate. In other types of centrifuges (e.g., a UniFuge manufactured by Pneumatic Scale Angelus), the centrifuge may employ automatic controls which optically sense the fill level in the bowl, in order to automatically control when to stop the feed pump and increase the rotational speed of the bowl.

Unfortunately for each of these examples, various circumstances may degrade the ability of these systems to consistently determine when a bowl is filled with the fluid, which can negatively affect the processing rate of the systems and/or cause carry-over of feed solids into centrate. For example, manually operated systems are susceptible to human error as to when liquid begins overflowing through the centrate discharge port. Also, automatic systems may be susceptible to the accumulation of small amounts of residual solids or foam in a sensing zone at which the presence of liquid is being detected optically. This effect can interfere with optical sensing of the actual fill level of the bowl. Further, the monitoring of liquid that has overflowed from the bowl into a discharge port (e.g., with a manual system or an automated system) can result in some contamination of the liquid exiting the discharge port with feed solids during each bowl filling cycle. Thus there is a need for improvement to existing centrifuge designs.

SUMMARY

The following is a brief summary of subject matter that is described in greater detail herein. This summary is not intended to be limiting as to the scope of the claims.

Described herein are various technologies relating to centrifuges which provide increased reliability and/or processing speeds. An example system may include a centrifuge having both a rotating portion (e.g., a spindle, shaft, bowl, etc.) and a non-rotating portion (centrifuge housing, shaft/spindle assembly housings, mounting brackets, etc.). The system may include at least one vibration sensor mounted to a non-rotating portion of the centrifuge. The vibration sensor for example may correspond to an accelerometer operative to output signals including vibration data representative of vibrational movement in one or more directions.

In this described example embodiment, the system may include at least one processor that is operatively configured (e.g., via software, firmware, hardware, electrical circuits/interfaces, etc.) to monitor the vibration data provided by the vibration sensor during at least the time periods before and while the bowl of the centrifuge is being filled with a feed fluid from a substantially empty state. The processor may also be operatively configured to determine responsive to the vibration data, when the level of vibration associated with the centrifuge is indicative of the bowl being substantially filled but not yet completely filled with the fluid. Responsive to this determination, the processor may be operatively configured to: cause a feed device such as a pump associated with the centrifuge to stop filling the bowl with the fluid; and cause a drive device such as a motor to increase the rotational speed of the bowl. Thereafter the processor may be operatively configured to cause further fluid to be pumped into the centrifuge.

Other aspects will be appreciated upon reading and understanding the attached figures and description.

DETAILED DESCRIPTION

Figure 1:
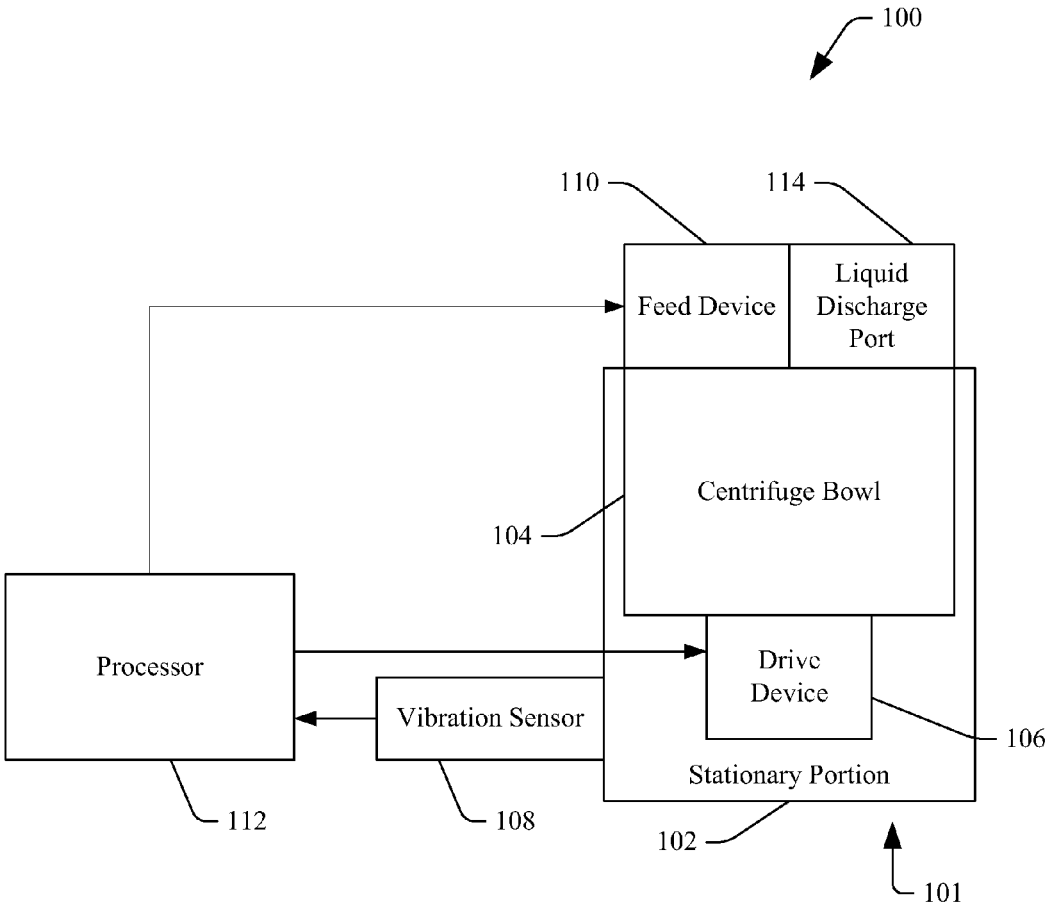
FIG. 1 is a schematic diagram of an example system that operates a centrifuge responsive to vibration data indicative of when a bowl is substantially filled with a fluid.

Various technologies pertaining to centrifuge systems will now be described with reference to the drawings, where like reference numerals represent like elements throughout. In addition, several functional block diagrams of example systems are illustrated and described herein for purposes of explanation; however, it is to be understood that functionality that is described as being carried out by certain system components and devices may be performed by multiple components and devices. Similarly, for instance, a component/device may be configured to perform functionality that is described as being carried out by multiple components/devices.

With reference to FIG. 1, an example system 100 that facilitates use of centrifugal forces to process fluids is illustrated. Such processes may involve the centrifugal separation of particulate solids such as cells from a liquid such as a cell culture media. For example such a process may comprise receiving a fluid feed comprising suspended cells from a bioreactor and separating the fluid into a cell concentrate portion and a centrate (liquid) portion. However, it is to be understood that in alternative embodiments the system may be employed with other fluid process applications that involve separation of solid particles suspended in liquids. As used herein a fluid is defined as a flowable medium that may include separable components including a liquid and solids. Also, as used herein the term solids corresponds to a plurality of particles, cells, and/or any other non-liquid matter included in the fluid along with one or more liquids.

In an example embodiment, the system may comprise at least one centrifuge 101. The centrifuge may include a stationary portion 102 (e.g., a housing, bracket, enclosure, or other non-rotating component) and a fluid receiving bowl 104 that is operative to rotate with respect to the stationary portion 102. The centrifuge may also include a drive device 106 that is operative to selectively control a rotational speed of the bowl. Such a drive device may include a motor that is operative to cause a spindle connected to the bowl to rotate at a plurality of different rotational speeds. Also, the drive device may include a belt that connects the motor to the spindle of the bowl. However, it is to be understood that in alternative embodiments, the drive device may have a motor configured in other arrangements to facilitate rotation of the bowl (e.g., direct drive, via gears, a transmission, and/or any other type of devices which are operative to transfer rotational energy from a motor to the bowl).

In example embodiments, the system may include a feed device 110 operative to selectively cause a fluid to be fed into the bowl 104. Such a feed device may for example include a pump, feed tubes, and/or one or more valves that are operative to direct fluid from a reservoir into the bowl.

In addition, an example embodiment may include at least one processor 112 that is in operative connection with the drive device 106 and feed device 110. The processor 112 may be incorporated into at least one of a computing system (e.g., such as a computer or dedicated controller) and may be operatively configured (via software, firmware) to control the drive device, feed device, and other functions of the centrifuge. For example, the at least one processor may be operative to turn the drive device on or off. Also the at least one processor may be operative to cause the drive device to rotate the bowl at different processing speeds (e.g., a relatively lower first rotational speed and a relatively higher second rotational speed). Further, the at least one processor may be operatively configured to control the operation of the feed device. For example, the at least one processor may be operative to turn on/off a pump and/or switch a valve between an open and closed state to control when the feed device moves fluid into the bowl. In addition, the at least one processor may be operatively configured to cause the centrifuge to carry out other functions associated with the operation and monitoring of the centrifuge.

An example embodiment of the centrifuge may experience varying degrees of vibrations depending on the amount of fluid in the bowl and the rotational speed of the bowl. In order to avoid excessive vibrations which may damage the centrifuge and/or degrade the processing characteristics of the centrifuge, the at least one processor may be operatively configured to cause the drive device to rotate the bowl at the relatively lower first rotational speed while the bowl is being initially filled with fluid from a substantially empty state. For example, at the beginning of a fill cycle, the at least one processor may cause the drive device to begin rotating the bowl at the first rotational speed and cause the feed device to begin pumping fluid into the bowl. The at least one processor may then be operatively configured to detect when the bowl is substantially filled with the fluid (which may be less than completely filled), and in response to this detection, the at least one processor may both cause the feed device to stop pumping fluid into the bowl and cause the drive device to increase the rotational speed of the bowl to the relatively higher second rotational speed. The relatively higher second rotational speed may have a generally more efficient ability to separate portions of the fluid (e.g., solids from liquid such as cells from centrate), in a manner that minimizes the risk of solids contaminating liquid flowing out of a discharge port 114 of the centrifuge. After a predetermined amount of time after the bowl begins rotating at the relatively higher second rotational speed (where the risk of solid contamination of the discharged liquid is lower), the at least one processor may be operatively configured to cause the feed device to begin again pumping fluid into the bowl.

In this described example, as fluid is being continually pumped into the bowl, liquid separated out of the fluid via the operation of the centrifuge may continually overflow through the discharge port into a collection reservoir. Simultaneously with the flow of discharged liquids into the collection reservoir, solids in the fluid may continually collect in the bowl via the operation of the centrifuge. Once a required batch of fluid has been processed in this manner, or when the bowl is sufficiently filled with solids, the at least one processor may be operatively configured to cause the bowl to be emptied (e.g., via pumping the solids out of the bowl and into a further reservoir). Once the bowl is emptied, the next cycle may begin in which the at least one processor causes the feed device to pump fluid into the empty (or substantially empty) bowl while the bowl rotates at the relatively lower first rotational speed.

In an example embodiment, the at least one processor is operative to determine when the bowl is substantially filled with fluid (but is not yet discharging liquid from a discharge port) by monitoring relative levels of vibrational movement experienced by portions of the centrifuge as the bowl is being filled with liquid. In an example embodiment, the centrifuge may include a vibration sensor 108 mounted to a stationary portion 102 of the centrifuge. Such a stationary portion may correspond to a portion of the housing that surrounds a shaft/spindle that is in operative connection with the bowl. However, it is to be understood that the vibration sensor (or additional vibration sensors) may be mounted to other portions of the centrifuge to measure vibrational movement. In this described example embodiment, the vibration sensor may correspond to an accelerometer or any other type of vibration sensor that is operative to generate vibration data representative of vibrational movement of portions of the centrifuge.

Figure 2:
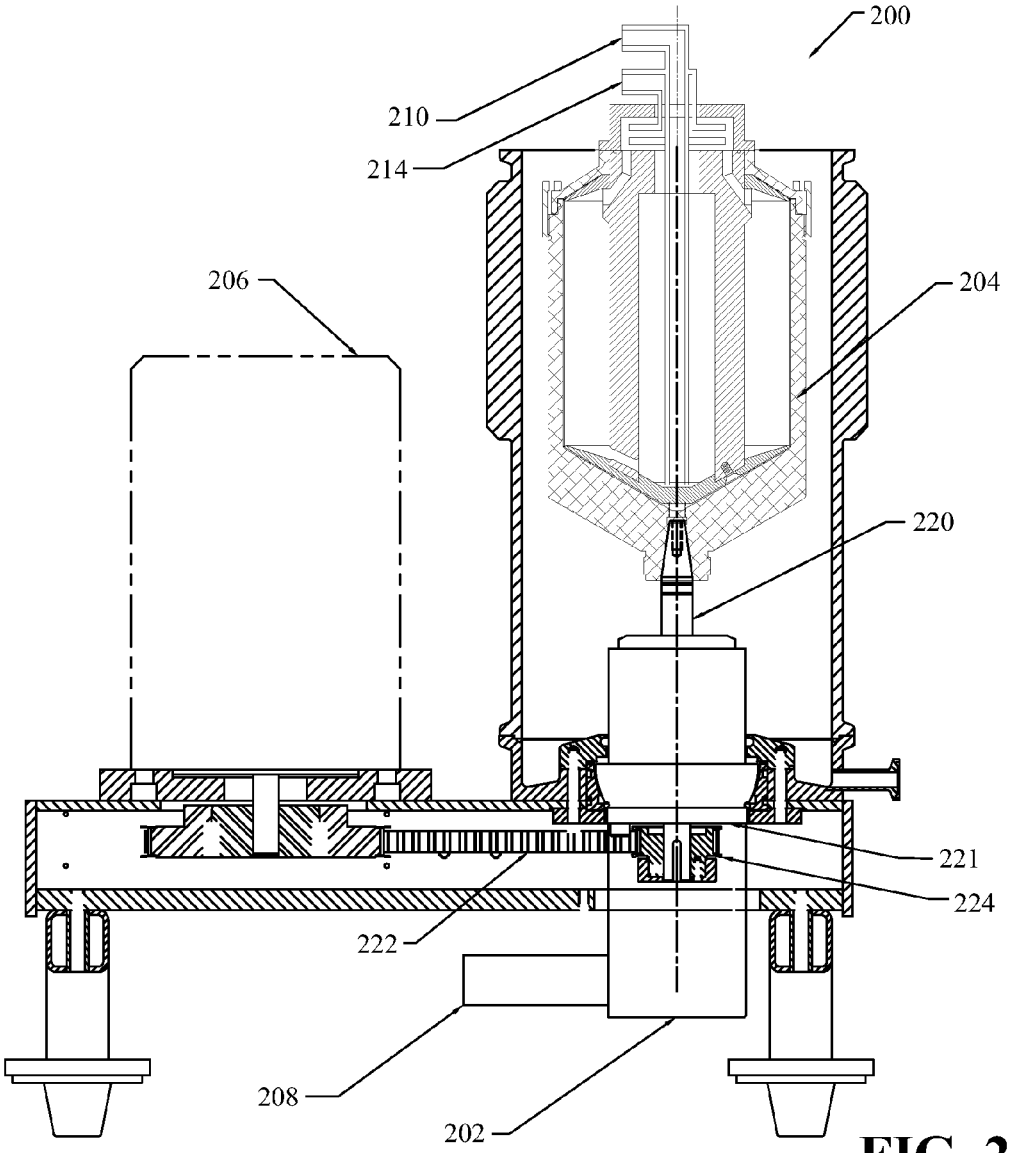
FIG. 2 is a cross-sectional view of an example embodiment of a centrifuge system.

FIG. 2 illustrates a cross-sectional view of a centrifuge 200 that may be adapted to correspond to the described system. In this example, the centrifuge 200 corresponds to a UniFuge manufactured by Pneumatic Scale Angelus. Here the centrifuge includes a bowl 204 that is connected to a spindle 220. The drive device includes a motor 206 that is operative to rotate the spindle 220, via an operatively connected belt 222 and pulley 224. In this example, which represents an example attachment configuration for a vibration sensor, the vibration sensor corresponds to an accelerometer 208 which is mounted to a portion of a housing or bracket 202. The bracket is positioned below the spindle 220, attached to the non-rotating spindle housing 221, and surrounds the pulley 224. FIG. 2 also shows an example of a centrate discharge port 214 through which liquid is discharged, as well as a feed port 210 through which a feed device (not shown) pumps suspension into the bowl 204.

Figure 3:
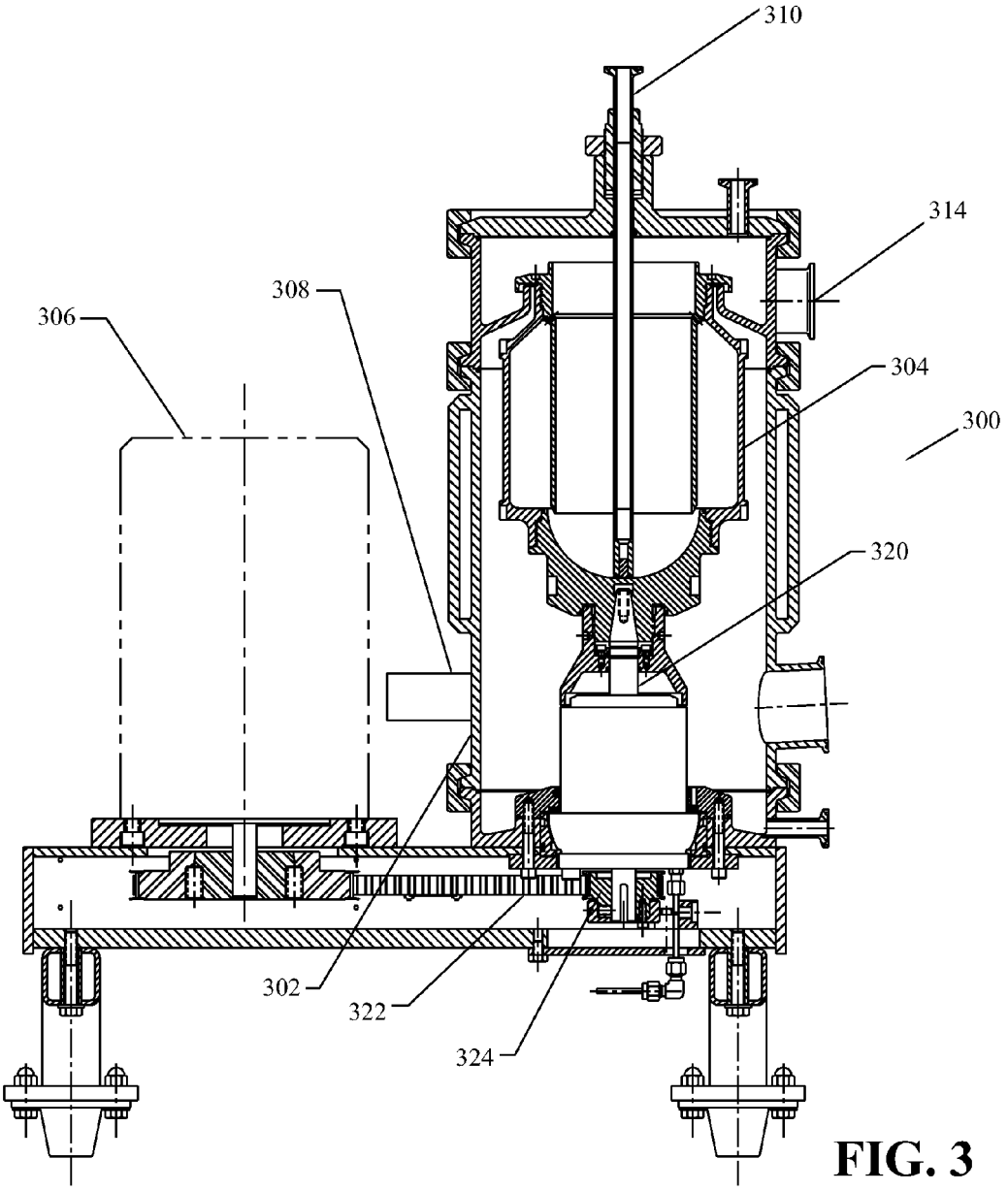
FIG. 3 is a cross-sectional view of an alternative example embodiment of a centrifuge system.

FIG. 3 illustrates a cross-sectional view of a further centrifuge 300 that may be adapted to correspond to the described system. In this example, the centrifuge 300 corresponds to a ViaFuge manufactured by Pneumatic Scale Angelus. As with previously described systems, the centrifuge includes a bowl 304 that is connected to a spindle 320. The drive device includes a motor 306 that is operative to rotate the spindle 320, via an operatively connected belt 322 and pulley 324. As in other embodiments, at least one vibration sensor 308 may be mounted to a non-rotating component such as the bowl case 302 or other stationary portion of the centrifuge. FIG. 3 also shows an example of a centrate discharge port 314 through which liquid is discharged, as well as a feed port 310 through which a feed device (not shown) pumps fluid into the bowl 304.

Figure 4:
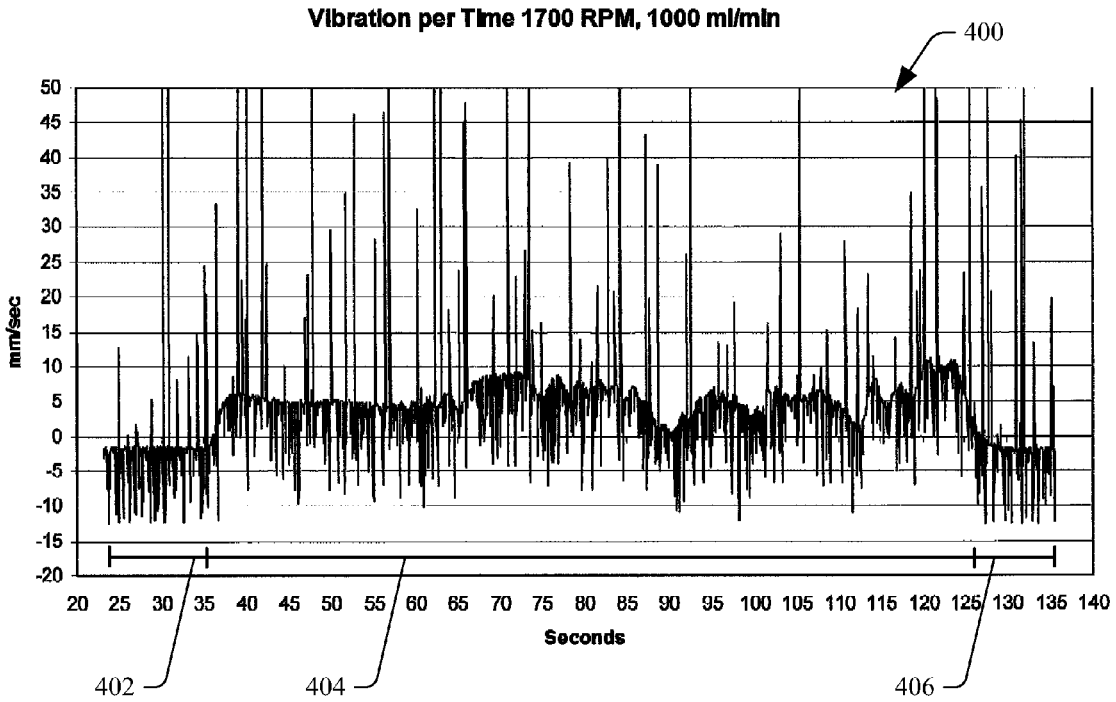
FIG. 4 is a graph of vibration data acquired via a vibration sensor mounted to a centrifuge while a bowl is being filled.

FIG. 4 illustrates an example graph 400 of vibration data from a system corresponding to that shown in FIG. 2. The vibration data was captured beginning at a first time period 402 while the bowl 204 was empty and spinning at the previously described relatively lower first rotation speed (which was 1700 RPM in this example). Subsequently, at a second time period 404 (starting at about 35 seconds in this example) the bowl was filled with a feed fluid (at a rate of 1000 ml/min in this example). As shown in the graph 404, the resulting vibration data reflects a relative increase in vibrational movement of the centrifuge compared to the vibrational movement before the bowl was being filled during the first time period (e.g., before about 35 seconds in this example).

This relatively increased level of vibrational movement continues until the bowl is at least 85% filled with fluid, whereafter the level of vibrational movement returns at a third time period 406 (greater than about 125 seconds in this example) to a lower level that, in this case, is relatively similar to the vibration level associated with the first time period 402 (below about 35 seconds in this example).

In an example embodiment of the system, the at least one processor may be operative to monitor the vibration data in order to determine when it is indicative of the bowl being substantially filled (e.g., greater than 85% filled). For example, the at least one processor may be operatively programmed to continuously monitor the vibration data (after fluid begins being pumped into the bowl) in order to detect when the vibration data returns to a specified level or passes through a predetermined sequence of vibration values. To determine an initial level, each time a fill cycle is about to begin, (i.e., when an empty or substantially empty bowl is spinning and prior to the at least one processor causing the feed device to begin feeding fluid into the bowl), the at least one processor may be operatively programmed to determine an average, or some other value, derived from the initial vibration level for the bowl. This derived value may then be continuously compared to current vibration measurements to determine when the bowl is substantially filled. Some form of noise reduction may be also applied to the vibration signal.

As shown in the graph 400, the vibration data may temporarily indicate a relative drop in vibration data before the bowl is substantially filled (e.g., see the graph 400 at about 90 seconds). Thus to avoid such temporary drops prematurely causing the processor to improperly detect when the bowl is substantially filled bowl, the at least one processor may be operatively programmed to continually average the most recent vibration data over several seconds to verify that the current vibration level of the bowl has indeed dropped to a continuous average level that is substantially similar to the determined average initial vibration level for when the bowl was empty. Other data reduction schemes may be used to prevent false "bowl is full" determinations. As used herein the substantially similar level corresponds to the current average vibration level being within a predetermined threshold range of the determined average initial vibration level for when the bowl was empty during the current cycle (or a previous cycle).

Also, it is to be understood that the at least one processor may be operatively programmed to monitor other characteristics of vibration data that may be indicative of the bowl being substantially filled. For example, in addition to monitoring average levels of the magnitude of vibrational movement in the bowl, the at least processor may be operative to evaluate vibration data for different axes, harmonics, or any other information that may indicate when the bowl is substantially filled.

In addition, it should be noted that the graph 400 was generated in a system in which the bowl was allowed to be continually filled with the feed fluid, until liquid began overflowing from the discharge port (at about 135 seconds in this example). However, it is to be understood that in example embodiments of the described system, when the processor determines that the bowl is substantially filled responsive to the vibration data, the at least one processor may be operative to stop the feed of fluid into the bowl and cause the rotational speed of the bowl to increase to the previously described relatively higher second rotational speed, before the liquid overflows into the discharge port (at about 135 seconds in this example).

In addition, it should also be noted that the same bowl may be reused for many cycles. Thus at the beginning of a second or subsequent cycle (i.e. after one cycle, but before new fluid is pumped into the bowl), the bowl may be substantially empty, but not completely empty. This may occur because residual solids and or liquid from the previous cycle may remain along the walls or bottom of the bowl after the bulk of the solids from previous cycles were pumped out of the bowl.

Further, it should be noted that the vibration data may indicate a substantially filled bowl at different fill levels depending on the geometry of the bowl, rotational speed of the bowl, characteristics of the fluid in the bowl, and other physical attributes of the centrifuge and the processing application. Thus as used herein a substantially filled bowl generally corresponds to a bowl that is more than 75% full and less than or equal to 100% full by volume, wherein after the bowl is 100% full, liquid begins to overflow into a discharge port.

In example embodiments of the system, the at least one processor may also be operative to monitor the vibration data for the presence of excessive vibrational movement that may damage the system or otherwise negatively impact the operational characteristics of the centrifuge. When such excessive vibrational movement is detected (e.g., via comparison of the vibration data to a predetermined threshold), the at least one processor may be operatively programmed to reduce the rotational speed at which the drive device spins the bowl and/or reduce the feed rate at which the feed device pumps fluid into the bowl. Also, the at least one processor may be operative to output alarm signals and or stop the processing of the centrifuge, when excessive vibrational movement continues to be detected.

Figure 5:
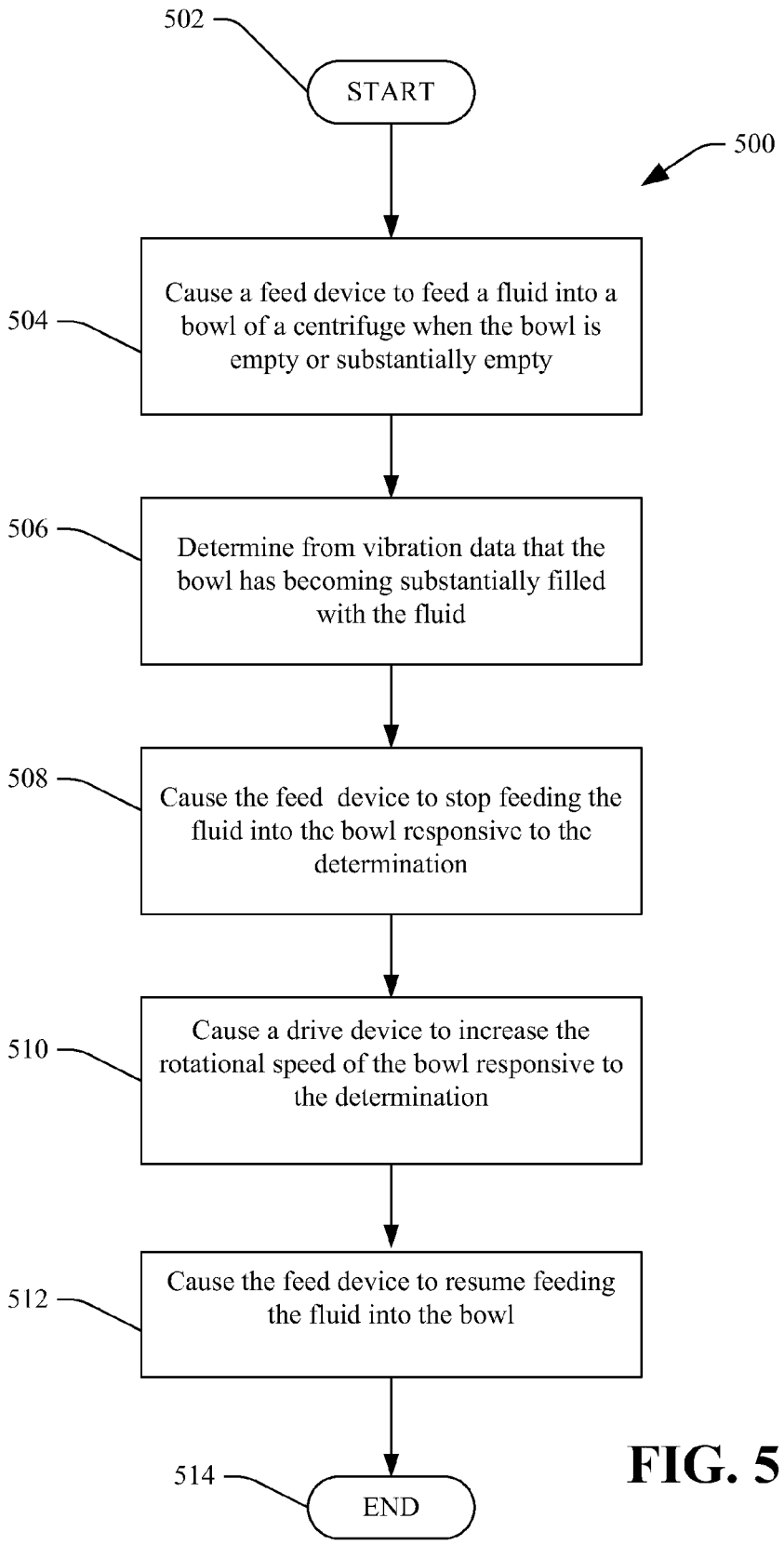
FIG. 5 is a flow diagram that illustrates an example methodology for operating a centrifuge responsive to vibration data indicative of when a bowl is substantially filled with a fluid.

With reference now to FIG. 5, an example methodology is illustrated and described associated with the operation of the previously described example systems. While the methodology is described as being a series of acts that are performed in a sequence, it is to be understood that the methodologies are not limited by the order of the sequence. For instance, some acts may occur in a different order than what is described herein. In addition, an act may occur concurrently with another act. Furthermore, in some instances, not all acts may be required to implement a methodology described herein.

Moreover, the acts described herein may be caused by computer-executable instructions that can be implemented by one or more processors and/or stored on a computer-readable medium or media. The computer-executable instructions may include a routine, a sub-routine, programs, a thread of execution, and/or the like. Still further, results of acts of the example methodologies may be stored in a computer-readable medium, displayed on a display device, and/or the like.

As illustrated in FIG. 5, the methodology 500 begins at 502, and at 504 includes a step of causing a feed device (e.g., pump) to feed a fluid (e.g., a liquid-solid suspension) into a bowl of a centrifuge when the bowl is substantially empty of such fluid.

Continuing at step 506, the methodology may include a step of determining from vibration data that the bowl has become substantially filled with the fluid. Responsive to this determination, the methodology may include a step 508 of causing the feed device to stop feeding the fluid into the bowl and of step 510 of causing a drive device to increase the rotational speed of the bowl. Also after a predetermined amount of time after the rotational speed has been increased, the methodology may include a step 512 of causing the feed device to resume feeding the fluid into the bowl.

This described process may then end at 514. However, it is to be understood that the methodology may involve additional steps to continue processing the fluid through one or more cycles of filling and emptying the bowl. For example, when the bowl has become filled with solids, the methodology may include a step of pumping solids or otherwise discharging solids out of the bowl to place the bowl in a substantially empty condition that is ready for a further cycle.

As used herein, the described at least one processor 112 may be included in a computing device (such as a computer or a dedicated controller) that executes instructions that are stored in a memory as software or firmware. The instructions may be, for instance, instructions for causing devices of the described system to operate or instructions for implementing one or more of the methods described above. The processor may access the memory by way of a system bus or other type of memory controller/bus.

The described computing device may include an input interface that allows external devices and/or users to communicate with the computing device. For instance, the input interface may be used to receive instructions from an external computer device and/or a user. The computing device may also include an output interface that interfaces the computing device with one or more external devices and/or a user. For example, the computing device may display text, images, etc. by way of the output interface.

Additionally, while illustrated as a single system, it is to be understood that the computing device may be a distributed system. Thus, for instance, the processor and several devices may be in communication by way of a network connection and may collectively perform tasks described as being performed by the described systems.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A system comprising:

a centrifuge including:

a stationary portion;

a fluid containable bowl, wherein the bowl is configured to rotate relative to the stationary portion about a bowl central axis;

a drive device, wherein the drive device is configured to selectively control a rotational speed of the bowl;

at least one vibration sensor, wherein the at least one vibration sensor is configured to generate vibration data responsive to vibrational movement of at least one portion of the centrifuge;

a feed device, wherein the feed device is configured to selectively cause a fluid to be fed into the bowl, wherein the fluid includes both liquid and solid constituents;

wherein rotation of the bowl is operative to separate the liquid and solid constituents in the fluid while the bowl holds the liquid and solid constituents within the bowl, at least one processor, wherein the at least one processor is configured to cause with the bowl substantially empty, an initial vibration level to be determined responsive at least in part to vibration data, the feed device to feed fluid into the bowl, a plurality of current vibration levels to be determined responsive at least in part to vibration data, comparison of the initial vibration level and the plurality of current vibration levels, a determination that the bowl is substantially filled with fluid responsive at least in part to a current vibration level being substantially similar to the initial vibration level, responsive at least in part to the determination the feed device to stop fluid feed into the bowl, and the drive device to increase the rotational speed of the bowl.

2. The system according to claim 1, wherein the centrifuge further includes a discharge port, wherein the bowl is configured to enable discharge of liquid from the discharge port, wherein the at least one processor is configured to determine from the vibration data that the bowl is substantially filled with the fluid prior to liquid overflow from the bowl through the discharge port.

3. The system according to claim 2, wherein the at least one vibration sensor is mounted in fixed operative connection with the stationary portion of the centrifuge.

4. The system according to claim 3, wherein the at least one vibration sensor includes an accelerometer.

5. The system according to claim 3, wherein the drive device includes a motor, wherein the feed device includes a pump, wherein the at least one processor is configured to control the operation of the motor and the pump responsive at least in part to vibration data.

6. A method carried out in connection with a centrifuge, wherein the centrifuge includes a rotatable bowl, a stationary portion, wherein the bowl is configured to rotate with respect to the stationary portion and about a bowl central axis, a drive, wherein the drive is operative to selectively rotate the bowl at a plurality of rotational speeds, at least one vibration sensor, wherein the at least one vibration sensor is operative to generate vibration data representative of vibrational movement of at least one portion of the centrifuge, wherein rotation of the bowl is operative to separate liquids and solids in fluid within the bowl while the bowl holds the liquids and the solids within the bowl, comprising:

(a) through operation of at least one processor, when the bowl is substantially empty, determining in response at least in part to vibration data, an initial vibration level representative of vibrational movement of the centrifuge;

(b) through operation of the at least one processor, causing a feed device to feed a fluid into the bowl when the bowl is substantially empty, wherein the fluid includes liquid and solids, (c) through operation of the at least one processor, determining that the bowl is substantially filled with the fluid, wherein the at least one processor is operative to make the determination responsive at least in part to vibration data changing during fluid feed into the bowl from the initial vibration level and returning to a vibration level that is substantially similar to the initial vibration level, (d) responsive at least in part to the determination, through operation of the at least one processor causing the feed device to reduce fluid feed into the bowl, and causing the drive to increase rotational speed of the bowl.

7. The method according to claim 6, wherein the centrifuge includes a discharge port, wherein in (c) the at least one processor makes the determination prior to liquid in the bowl beginning to overflow from the bowl through the discharge port.

8. The method according to claim 6, wherein the drive includes a motor, and wherein the feed device includes a pump, wherein (d) includes the at least one processor, causing the motor to increase the rotational speed of the bowl, and causing the pump to stop feeding the fluid into the bowl.

9. The method according to claim 7, wherein the at least one vibration sensor providing vibration data in (c) is mounted in fixed operative connection with the stationary portion of the centrifuge.

10. The method according to claim 9, wherein the at least one vibration sensor providing vibration data in (c) includes an accelerometer.

11. At least one computer-readable medium comprising instructions that, when executed by at least one processor of a centrifuge system controller, cause a centrifuge system to perform acts comprising:

(a) operating a feed device to feed a fluid into a rotatable bowl of a centrifuge when the bowl is substantially empty, wherein the fluid includes liquid and solids, wherein the centrifuge includes a stationary portion, wherein the bowl is operative to rotate about a central axis of the bowl and such rotation separates the liquid and solids in the fluid while the bowl holds the liquid and solids of the fluid within the bowl, wherein the bowl rotates with respect to the stationary portion, wherein the centrifuge includes a drive operative to selectively rotate the bowl at a plurality of rotational speeds, wherein the centrifuge includes at least one vibration sensor operative to generate vibration data representative of vibrational movement of at least one portion of the centrifuge;

(b) operating the drive to cause the bowl to rotate at a first rotational speed during at least a portion of a filling time when fluid is fed into the bowl through operation of the feed device, (c) determining by the controller in response at least in part to vibration data, that the bowl is substantially filled with the fluid, wherein the controller is operative to make the determination responsive at least in part to vibration data changing during fluid feed into the bowl from an initial vibration level when the bowl is substantially empty, and subsequently returning to a vibration level that is substantially similar to the initial vibration level, (d) in response at least in part to the determination, operating the drive to increase rotational speed of the bowl above the first rotational speed.

12. A system comprising:

a centrifuge including:

a stationary portion;

a fluid containable bowl, wherein the bowl is configured to rotate relative to the stationary portion about a bowl central axis;

a drive device, wherein the drive device is configured to selectively control a rotational speed of the bowl;

at least one vibration sensor, wherein the at least one vibration sensor is configured to generate vibration data responsive to vibrational movement of at least one portion of the centrifuge;

a feed device, wherein the feed device is configured to selectively cause a fluid to be fed into the bowl, wherein the fluid includes both liquid and solid constituents;

wherein rotation of the bowl is operative to separate the liquid and solid constituents in the fluid while the bowl holds the liquid and solid constituents within the bowl, at least one processor, wherein the at least one processor is configured to determine in response at least in part to vibration data during bowl filling through operation of the feed device, that the rotating bowl is substantially filled with the fluid, wherein the at least one processor is operative to cause the determination to be made responsive to at least one of vibration data corresponding to a vibration level generally corresponding to that when the bowl is substantially empty, and vibration data passing through a sequence corresponding to a plurality of different vibration levels as the bowl fills with the fluid, wherein the at least one processor is operative to average at least some vibration data over a time period and to cause the determination to be made responsive at least in part to the averaged vibration data, and cause the drive device to increase the rotational speed of the bowl responsive at least in part to the determination.

* * * * *